United States Patent [19]

Sugimoto et al.

[11] 4,374,557

[45] Feb. 22, 1983

[54] COIN CHANGER FOR A VENDING MACHINE

[75] Inventors: Osamu Sugimoto; Masaki Akagawa; Yukichi Hayashi, all of Sakado, Japan

[73] Assignee: Kabushiki Kaisha Nippon Coinco, Tokyo, Japan

[21] Appl. No.: 206,690

[22] Filed: Nov. 14, 1980

[30] Foreign Application Priority Data

Nov. 22, 1979 [JP] Japan ..... 54/162251[U]

[51] Int. Cl.[3] ..... G07F 3/02

[52] U.S. Cl. ..... 194/100 A; 133/3 R

[58] Field of Search ..... 133/2, 3 R; 194/100 A, 194/10, 13, DIG. 0.02, DIG. 0.03

[56] References Cited

U.S. PATENT DOCUMENTS 4,228,811 10/1980 Tanaka et al. ..... 194/100 A

*Primary Examiner*—Stanley H. Tollberg

*Attorney, Agent, or Firm*—Spensley, Horn, Jubas & Lubitz

[57] ABSTRACT

A coin changer comprises a coin changer main part and an electronic type coin discrimination device which can be readily mounted to and detached from the coin changer main part. The electronic type coin discrimination device includes a detection coil for detecting characteristics of a deposited coin, a discrimination circuit for judging whether the deposited coin is a true coin or a counterfeit one in response to the output of the detection coil and produces a sole kind of discrimination signal representative of trueness or falsity of the coin regardless of the denomination of the coin, a true coin passage and a counterfeit coin passage provided behind the detection coil and a mechanical coin sort-out device provided in the true coin passage for sorting out coins by denomination. The coin changer main part comprises coin switches for detecting coins of respective denominations having been sorted out by the sort-out device, a coin receiving device for receiving the coins which have passed through the coin switches, a control circuit for effecting control operations including a money amount counting control, a vend control and a change payout control, and an electromagnetic device for distributing the deposited coin to either the true coin passage or the counterfeit coin passage in the coin discrimination device in response to the output of the discrimination circuit. This electromagnetic device distributes the coins by projecting or withdrawing a reject pin into or from a bifurcation of the true coin passage and the counterfeit coin passage.

4 Claims, 5 Drawing Figures

COIN CHANGER FOR A VENDING MACHINE

SUMMARY OF THE INVENTION

This invention relates to a coin changer for a vending machine and, more particularly, to a coin changer including a readily detachable electronic type coin discrimination device.

For discriminating a true coin from a counterfeit one among deposited coins and further sorting out true coins by denomination, there are two types of devices, that is, a mechanical type device which conducts discrimination of a true coin from a counterfeit one mechanically and an electronic type device which conducts such discrimination electronically. The electronic type coin discrimination device is capable of discriminating a true coin from a counterfeit one more accurately than the mechanical type device but is more expensive than the latter. The mechanical type device and the electronic type device have both merits and disadvantages in accuracy and costs. For this reason, which of the mechanical type device and the electronic type one should be adopted for a coin changer of a vending machine cannot be determined unconditionally. Accordingly, it is desirable to use either of these two types of devices at will when it is required. In conventional vending machines it is not possible to mount a desired one of the mechanical type device and the electronic type device at will to a main part of a coin changer, even if a coin discrimination device can be detached from the main part of the coin changer. In other words, the mechanical type coin discrimination device and the electronic type coin discrimination device are not interchangeable with each other in the conventional vending machine. If, accordingly, there arises an occasion in which the mechanical type coin discrimination device needs to be replaced by the electronic type device, or vice versa, an entire coin changers must be replaced which apparently incurs an extra cost.

It is, therefore, an object of the present invention to provide a coin changer in which whichever of the electronic type coin discrimination device and the mechanical type one can be mounted at will to a coin changer main part. On the basis of a finding that a cause for the uninterchangeability between the electronic type coin discrimination device and the mechanical type device is attributable to the construction of the prior art electronic type coin discrimination devices, the present invention is intended to achieve the above described object by improving relations between the electronic type coin discrimination device and other component parts of the coin changer.

The electronic type coin discrimination device generally has detection coils along a coin passage and discriminates a true coin from a counterfeit one as well as denominations of coins in accordance with coin detection signals produced by these detection coils. In the prior art electronic type coin discrimination devices, a discrimination circuit in which an ac signal is supplied to a primary side of the detection coils and trueness or falsity as well as denomination of a deposited coin is judged in accordance with a detection signal provided from a secondary side of the detection coil is provided not in the coin discrimination device itself but in the main part of the coin changer. The electronic type coin discrimination device is electrically connected to the discrimination circuit provided in the main part of the coin changer by a large number of wires and is detachable from the main part of the coin changer by means of a connector provided for these wires. Since, however, the size of the connector is limited on account of space available in the changer and a large number of wires must be connected by the connector of the limited size, the number of pins provided on the connector is excessively large and each of these pins has to be of an extremely small diameter. The prior art electronic type coin discrimination device, therefore, cannot be readily detached from the main part of the coin changer notwithstanding the provision of the connector. If the device was detached too frequently, deformation of the pins would occur resulting in the damage of the connector. It is, therefore, another object of the invention to facilitate detaching and mounting of the connector of the electronic type coin discrimination device.

In the prior art coin changer including the electronic type coin discrimination device, denomination of a deposited coin is judged by the discrimination circuit provided in the main part of the coin changer as described above and counting of deposited coins is conducted in accordance with results of judging the denomination of the coins. The construction of an electrical control circuit provided in the main part of the coin changer differs greatly from a case where the mechanical type coin discrimination device is employed. Accordingly, the electronic type coin discrimination device is not interchangeable with the mechanical type coin discrimination device in respect of processing of coins by denominations in the electronic control circuit in the coin changer main part aside from the question of whether or not the electronic type coin discrimination device and the mechanical type one are physically interchangeable with each other. It is, therefore, another object of the invention to improve the electrical control circuit provided in the coin changer main part so that it can be used commonly for both the electronic type coin discrimination device and the mechanical type one.

More specifically, the object of the invention can be achieved in the following manner: A discrimination circuit which judges whether a deposited coin is true or false in response to the output of the detection coil provided in the electronic type coin discrimination device is provided in the electronic type coin discrimination device. Besides, the descrimination circuit is so constructed that it will produce only one kind of discrimination signal representing trueness or falsity of deposited coins regardless of denomination of the coin and not a discrimination signal representing trueness or falsity of the deposited coins denomination by denomination. This arrangement enables the number of wires between the electronic type coin discrimination device and the coin changer main part to be reduced to only two, i.e., a power supply line and a control line corresponding to the single kind of discrimination output of the discrimination circuit with a resulting reduction in the number of pins to be provided on the connector. Consequently, detaching and mounting of the connector is greatly facilitated and the connector can be made rigid enough to withstand frequent detaching and mounting. Thus, the electronic type coin discrimination circuit can be readily detached and remounted. Aside from the coin discrimination device, coin switches for detecting passing coins are provided in suitable places in coin passages of the coin changer main part through which coins of respective denominations having been sorted out by the coin discrimination device pass and the numbers of coins of the respective denominations are counted in accordance with the output of these coin switches. Since these coin switches are not attached to the coin discrimination device, they are left on the side of the coin changer main part after detaching of the coin discrimination device so that they can be used for either one of the electronic type coin discrimination device and the mechanical type one. Alternatively stated, the output of the detection coil of the electronic type coin discrimination device is utilized not for counting of deposited coins by denominations but only for discriminating a true coin from a counterfeit one and a signal for counting the number of coins is produced by the coin switches whereby the electrical control circuit (including the counting function) of the coin changer main part can be used for both the electronic type coin discrimination device and the mechanical type coin discrimination device.

DESCRIPTION OF A PREFERRED EMBODIMENT

Figure 1:
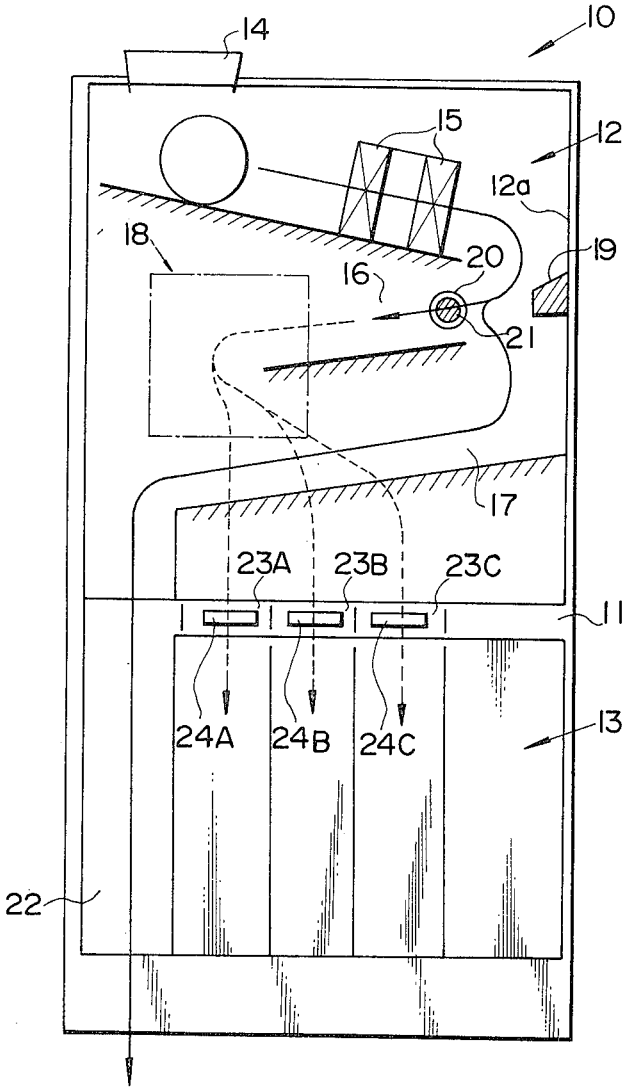
FIG. 1 is a front view schematically showing an embodiment of the coin changer made according to the invention.

Referring first to FIG. 1, an electronic type coin discrimination device 12 is detachably mounted in the upper portion of a coin changer main part 11 of a coin changer 10 and a coin receiving device 13 is mounted in the lower portion of the main part 11 below the coin discrimination device 12. The coin receiving device 13 which receives deposited coins denomination by denomination may be fixedly provided in the main part 11 or may be detachably mounted therein in the form of a cassette. The electronic type coin discrimination device 12 comprises a coin inlet 14, a detection coil 15 for detecting characters of a coin thrown in through the coin inlet 14, a true coin passage 16 and a counterfeit coin (or a coin to be returned) passage 17 which bifurcate at a post stage of the detection coil 15 and a sort-out device 18 which sorts out coins led to the true coin passage 16 by denomination. The electronic type coin discrimination device 12 further comprises a discrimination circuit which discriminates a true coin from a counterfeit one in accordance with the output of the detection coil 15. At the bifurcation of the true coin passage 16 and the counterfeit coin passage 17 is provided a projection 19 secured to a frame 12*a* of the coin discrimination device 12 against which a coin which has passed through the detection coil 15 collide and thereby is directed to the true coin passage 16. An aperture 20 through which a reject pin 21 can project and withdraw is formed at an entrance of the true coin passage 16 in the frame 12*a*. The reject pin 21 is provided on the coin changer main part 11 in such a manner that it will reciprocably project through the aperture 20 into the true coin passage 16 from behind the coin discrimination device 12. When the reject pin 21 is in its projecting position, a coin is led to the counterfeit coin passage 17. The counterfeit coin passage 17 communicates with a coin return passage 22 when the coin discrimination device 12 is accurately mounted in the main part 11.

When the pin 21 is in its withdrawn position behind the coin discrimination device 12, the coin having been directed to the true coin passage 16 by the projection 19 passes through the true coin passage 16 into the sort-out device 18 where the coin is mechanically sorted out by denomination. The sort-out device consists of a known mechanism which sorts out coins by denomination on the basis of either configuration or other factors and detailed description thereof is omitted. When the coin discrimination device 12 is accurately mounted in the main part 11, coins which have been sorted out by denomination by the sort-out device 18 are received in the coin receiving device 13 denomination by denomination through passages 23A, 23B and 23C formed in the main part 11 for the respective denominations. Coin switches 24A, 24B and 24C are provided in these passages 23A, 23B and 23C. Each of the coin switches 24A, 24B and 24C is actuated in response to passing of each coin and produces a coin detection pulse corresponding to weight of the coin of each denomination (i.e., amount of the coin).

Figure 2:
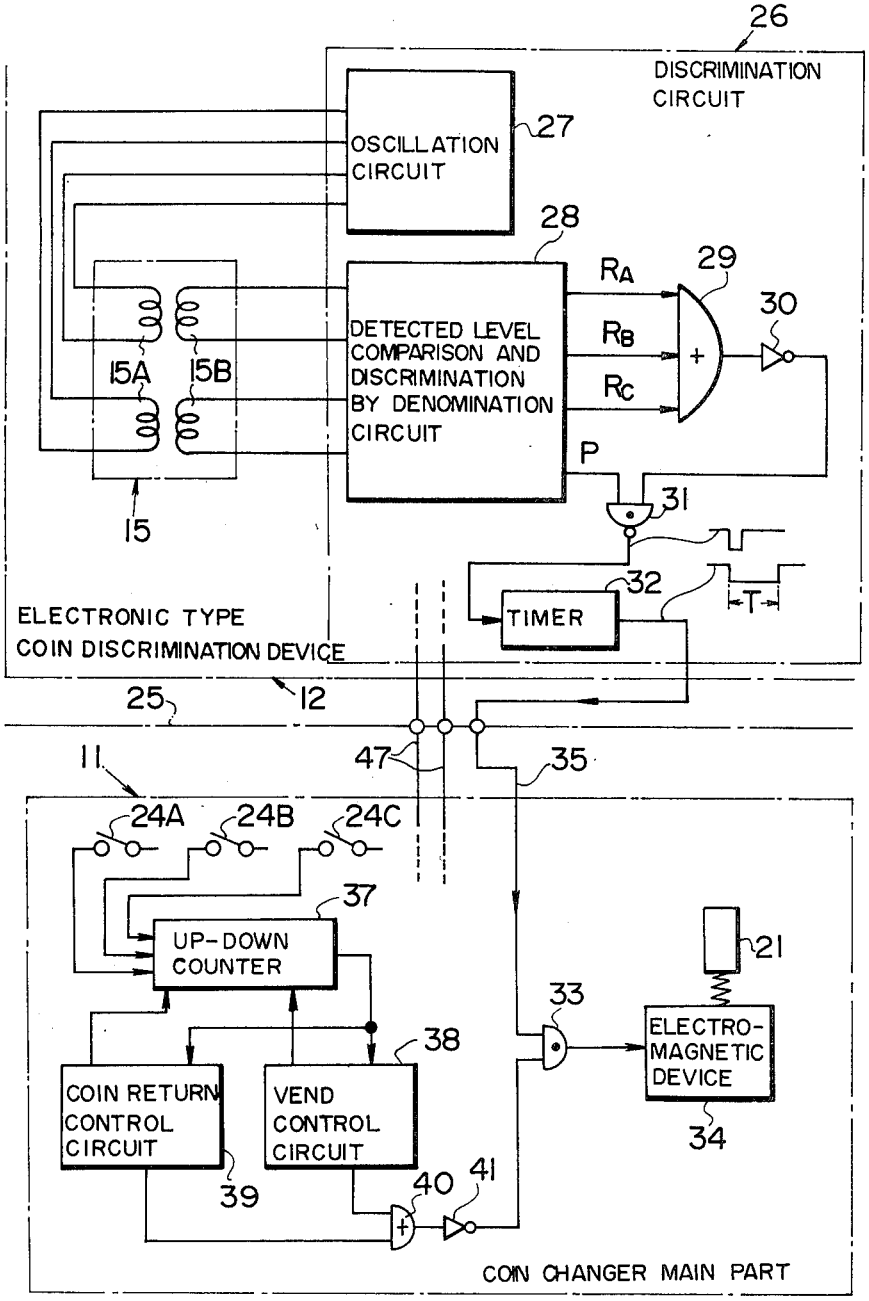
FIG. 2 is a block diagram showing an essential portion of an electrical construction of the embodiment.
Figure 3:
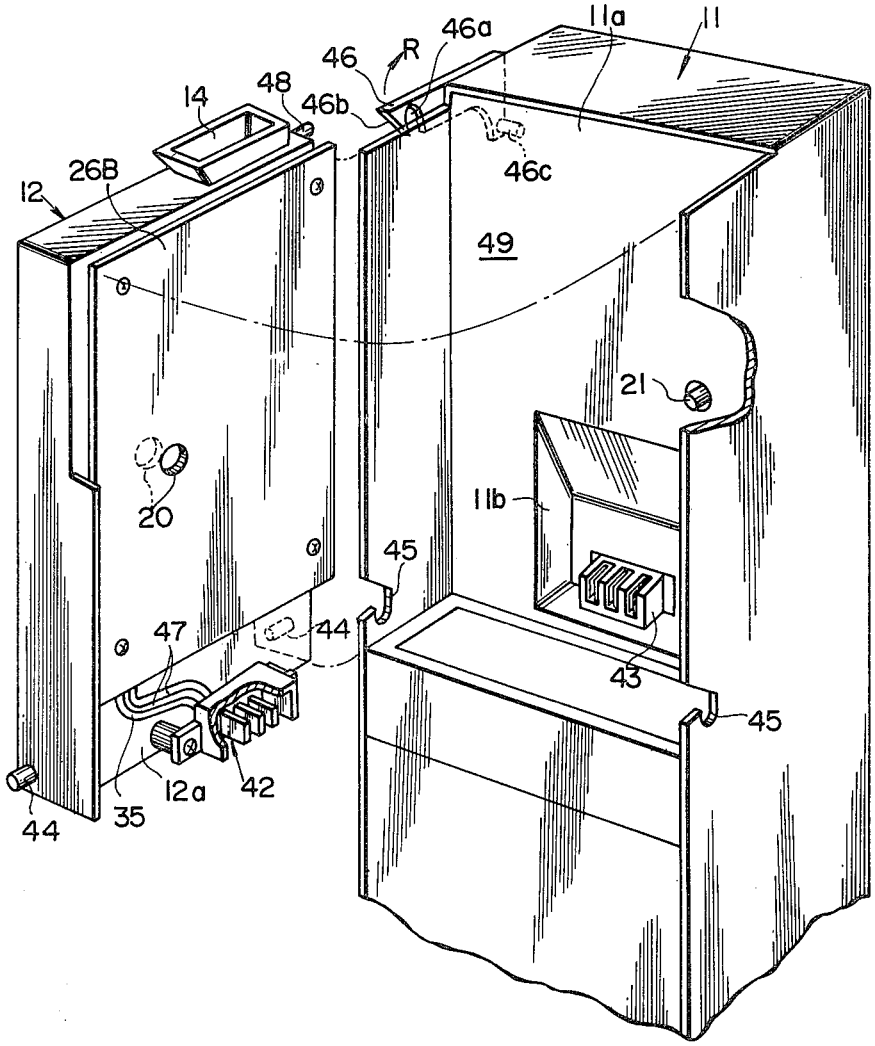
FIG. 3 is a perspective outside view schematically showing an electronic type coin discrimination device in the embodiment in a state in which the coin discrimination device is detached from the coin changer main part and is partly cut away.

FIG. 2 is a block diagram showing the electrical construction of the coin changer 10 according to the invention. In FIG. 2, the circuit provided in the electronic type coin discrimination device 12 is separated from the circuit provided in the coin changer main part 11 by a chain-and-dot line 25. The circuit provided in the coin discrimination device 12 includes the detection coil 15 and the discrimination circuit 26. A base 26B on which the discrimination circuit 26 is provided is mounted on the back of the coin discrimination device 12 as shown in FIG. 3.

In the discrimination circuit 26, an oscillation circuit 27 supplies an ac signal of a frequency suitable for detecting characters of coins such as materials and configurations of the coins to a primary coil 15A of the detection coil 15. A detected-level-comparison-and-discrimination-by-denomination circuit 28 discriminates a true coin from a counterfeit one in accordance with the output of a secondary coil 15B of the detection coil 15 and produces a signal P representing that a coin has passed and, if that coin has been found to be a true coin, one of true coin signals $R_A$, $R_B$ and $R_C$ corresponding to respective denominations in accordance with the denomination of that coin. The true coin signals $R_A$, $R_B$ and $R_C$ for the respective denominations are applied to an OR gate 29 and then are applied to a NAND gate 31 after being inverted by an inverter 30. The NAND gate 31 receives at another input thereof the signal P indicating the passage of the coin. Accordingly, the output of the NAND gate 31 normally is "1" and is turned to "0" (i.e., a counterfeit coin signal) when the coin passes the detection coil 15 if the coin is a counterfeit one whereas the output of NAND gate 31 remains to be "1" if the coin is a true one. The output of the NAND gate 31 is applied to a timer 32 from which a bifurcation control signal is provided. The timer 32 produces a signal "0" with a time width T when the input thereto (i.e., the output of the NAND gate 31) falls to "0".

The output of the timer 32 is applied as the output of the discrimination circuit 26 to a coin reject electromagnetic device 34 through an AND gate 33 provided in the main part 11. The electromagnetic device 34 is provided for causing the reject pin 21 to project or withdraw to sort out true coins and counterfeit ones. When the electromagnetic device 34 is energized, the reject pin 21 is attracted thereto and is withdrawn from the true coin passage 16 (FIG. 1), whereas when the electromagnetic device 34 is deenergized, the reject pin 21 is caused to project into the true coin passage 16.

The output of the AND gate 33 normally is "1" so that the reject pin 21 normally is in its withdrawn state. If the passing coin has been found to be a counterfeit one by the discrimination circuit 26, the bifurcation control signal on a line 35 is turned to "0" during the time period T. This causes the output of the AND gate 33 to turn to "0" thereby to deenergize the electromagnetic device 34 and enable the reject pin to project into the true coin passage 16 during the time period T. The counterfeit coin therefore is guided to the counterfeit coin passage 17. If the passing coin has been found to be a ture coin by the discrimination circuit 26, the signal on the line 35 remains to be "1" and the electromagnetic device 34 is not deenergized so that the reject pin 21 remains in its withdrawn position and the coin is guided to the true coin passage 16.

Principal functions of the control circuit provided on the side of the coin changer main part 11 are known control functions such as cumulatively counting deposited coins for judging whether a selected article is vendible or not and paying out change. For example, the coin detection pulses provided by the coin switches 24A, 24B and 24C (FIG. 1) are applied to an up-down counter 37 in which an amount of deposited coins is counted by cumulatively adding amounts of the deposited coins. A vend control circuit 38 compares contents of the counter 37 (the amount of the deposited coins) with a preset vend price of the article to be bended and thereupon supplies a vend possible signal to a vender unit (not shown) and also subtracts the price of the vended article from the contents of the counter 37. The vender unit dispenses the selected article in response to this vend possible signal. A coin return control circuit 39 controls payout of change or returning of the amount of deposited coins upon completion of vending of the selected article or the customer's demand for return of the deposited money and causes the amount to be returned from the contents of the up-down counter 37. In case the coins are returned to the customer, a payout mechanism (not shown) provided in the lwoer portion of the coin receiving device 13 is actuated to pay out coins. In addition, a signal representing a vend mode or a money return mode is supplied from the circuits 38 and 39 to an OR gate 40 and is applied to the AND gate 33 through an inverter 41. Accordingly, the output of the inverter 41 is "0" and the output of the AND gate 33 is also "0" during the vend mode or the money return mode. The electromagnetic device 34 therefore is deenergized to cause the reject pin 21 to project into the true coin passage 16 and coins thrown in the slot 14 are all returned no matter whether they are true coins or counterfeit ones.

An electric power is supplied to the discrimination circuit 26 of the coin discrimination device 12 from the side of the main part 11. Accordingly, the coin discrimination device 12 and the main part 11 are connected with each other by two kinds of wirings, namely a power supply line and a control line for the electromagnetic device 34. The number of the lines required for the two kinds of wirings is only two at the minimum and four at the maximum (i.e., two power supply lines, a signal line and ground conductor for the control line). In the case of employing the minimum number of two lines, the power supply lines (two lines) are concurrently utilized for the purpose of the control line in such a manner that the counterfeit coin signal is formed by difference in the voltage level. In the embodiment shown in FIG. 2, there are two power supply lines 47 and one control line 35. In this embodiment, the power supply lines 47 serve also for the ground conductor for the control line.

Figure 4:
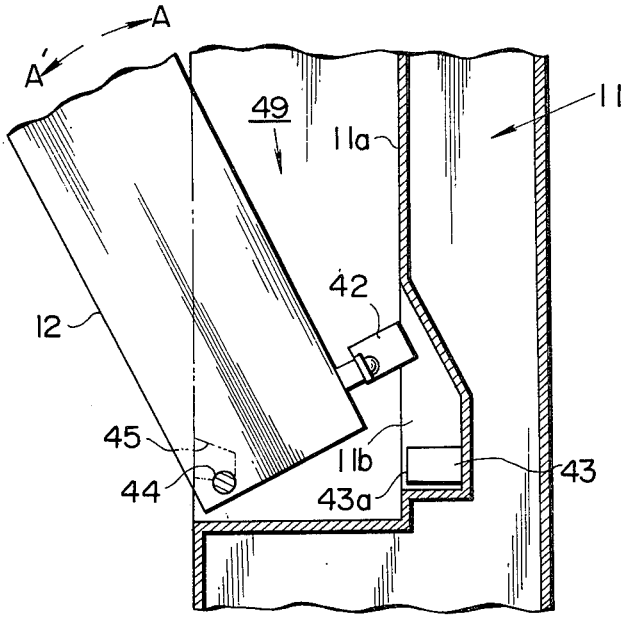
FIG. 4 is a side view, partly in section, showing the electronic type coin discrimination device of FIG. 3 in a state in which it is being mounted to or detached from the coin changer main part.

FIG. 3. shows the electronic type coin discrimination device 12 in a state in which it is detached from the main part 11. A connector plug 42 is provided in the lower portion of the rear surface of the frame 12*a* of the coin discrimination device 12. The connector plug 42 has three pins to which the two power supply lines 47 and the single control line 35 are respectively connected. A connector socket 43 is provided at a position opposite to the plug 42 on the main part 11. The number of pins is three in the present embodiment in correspondence to the three lines. Including the cases where the number of the pins is two or four, the number of the pins used in the plug of the device according to the invention is so small that these pins may be provided with a sufficiently large diameter and therefore are made very solid and strong. Disengagement of the connector plug 42 from the socket 43 apparently is easy and the coin discrimination device 12 can be readily detached from the main part 11. The plug 42 projects from the rear surface of the coin discrimination device 12. A frame 11*a* of the main part 11 which defines coin discrimination device receiving space 49 has a recessed portion 11*b* in the lower portion thereof. This recessed portion 11*b* is located opposite to the projecting plug 42 and the socket 43 is provided in the recessed portion 11*b*. The socket 43 is disposed in such a manner that the front end portion 43*a* thereof will not project forwardly from a vertical plane of the frame 11*a* as shown in FIG. 4 so as not to become an obstacle when the mechanical type coin discrimination device (not shown) is received in the receiving space 49 instead of the electronic type coin selection device 12.

Figure 5:
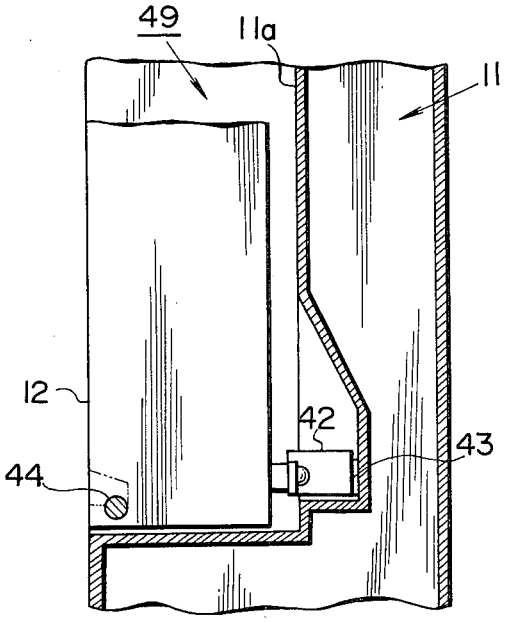
FIG. 5 is a side view, partly in section, showing the electronic type coin discrimination device of FIG. 3 in a state in which it has been completely mounted in the coin changer main part.

The coin discrimination device 12 is mounted to the main part 11 in the following manner. The coin discrimination device 12 is located obliquely with pins 44 provided on the lower side surface of the coin discrimination device 12 engaged in recesses 45 formed in the lower side walls of the main part 11 (FIG. 4). The coin discrimination device 12 is then pushed toward the main part 11 and it moves in a pivotal motion about the pins 44 in a direction of arrow A causing the connector plug 42 to fit in the socket 43 (FIG. 5). In the meanwhile, a pin 48 provided on the upper portion of one side surface of the coin discrimination device 12 is brought into abutment with an inclined surface 46*b* of a pivotable member 46 and, as the pin 48 moves rearwardly, it pushes the member 46 upwardly in the direction of an arrow R. The member 46 is pivotably mounted on one side of the main part 11 by means of a pivot pin 46C. When the coin discrimination device 12 has been completely mounted in the main part 11, the pin 48 enters a recess 46a of the member 46 and the member 46 falls upon the pin 48 to engage with it. The coin discrimination device 12 thereby is locked. When the coin discrimination device 12 is to be detached from the main part 11, the member 46 is pivoted in the direction of the arrow R to disengage the pin 48 from the recess 46a. The coin discrimination device 12 is then pulled forwardly in a pivotal motion in the direction of an arrow A' in FIG. 4 to pull the plug 42 out of the socket 43 and subsequently the device 12 is completely detached from the main part 11 by disengaging the pins 44 from the recess 45.

As described above, connection and disconnection of the plug 42 and the socket 43 are effected simultaneously with mounting and detaching of the coin discrimination device 12 to and from the main part 11 so that replacement of the coin discrimination device 12 can be made very easily.

In the above described embodiment of the invention, the reject pin 21 is normally withdrawn and is caused to project to guide a counterfeit coin to the counterfeit coin passage 17 only temporarily when the counterfeit coin has been detected. Since most of deposited coins are true coins, this arrangement is preferable in that it obviates necessity to frequently actuate the reject pin 21. Conversely, however, the reject pin 21 may normally be in its projecting position and be temporarily withdrawn to guide a true coin to the true coin passage 16 only when the true coin has been detected.

A mechanical type coin discrimination device (not shown) which is interchangeable with the electronic type coin discrimination device 12 according to the invention has only to be identical with the electronic type coin discrimination device 12 in its outside configuration, that is, it will suffice if passage of coins having been sorted out by denomination by the mechanical type coin discrimination device are in register with the coin passages 23A, 23B and 23C for the respective denomination of the main part 11, a counterfeit coin passage is in register with the coin return passage 22 of the main part 11 and the mechanical type coin discrimination device is accommodated in the receiving space 49. Coins having been sorted out by denomination by the mechanical type coin discrimination device actuate the coin switches 24A, 24B and 24C provided in the coin passages 23A, 23B and 23C of the main part 11 to produce the coin detection pulses. Accordingly, the electric control circuit in the main part 11 shown schematically in FIG. 2 may be utilized as efficiently for the mechanical type coin discrimination device as for the electronic type coin discrimination device 12.

What is claimed is:

1. A coin changer for a vending machine comprising:

an electronic type coin discrimination device including a discrimination means for electronically discriminating a true coin from a counterfeit coin among deposited coins, a true coin passage and a counterfeit coin passage provided at a post stage of said discrimination means and sort out means for sorting out coins guided to said true coin passage by denomination; and a coin changer main part including coin receiving means for receiving coins having been sorted out by said sort out means, control means for controlling operations such as counting the amount of deposited coins, vending of an article and returning of money and an electromagnetic device controlled by a discrimination signal representative of trueness or falsity of the deposited coin provided from said discrimination means and also by said control means to cause a reject member to project into or to be withdrawn from a predetermined point immediately before entrances to said true coin passage and said counterfeit coin passage for guiding the deposited coin to either one of said passages characterized in that said coin changer main part further comprises coin detection means for generating signals for counting the amount of the deposited coins for respective denominations in response to passing of the coins having been sorted out by said sort out means, said signals being supplied to said control means and that the output of said discrimination means in said electronic type coin discrimination device is utilized not for controlling counting of the amount of the deposited coins but only for controlling said electromagnetic device, electric wirings connect said coin changer main part with said coin discrimination device, said electric wirings being provided with disengageable connector means, and said electronic type coin discrimination device is detachably mounted in said coin changer main part.

2. A coin changer for a vending machine as defined in claim 1 wherein said connector means comprises a plug secured on one of frame portions of said electronic type coin discrimination device and said coin changer main part and a socket secured on the other of said frame portions, which frame portions face each other when said coin discrimination device is mounted in said coin changer main part, said connector means being engaged with and disengaged from each other in accordance with mounting and detaching of said electronic type coin discrimination device to and from said coin changer main part.

3. A coin changer for a vending machine as defined in claim 2 wherein a place in said coin changer main part in which said socket (or said plug) is secured is a recess of such a configuration that said socket (or said plug) will not become an obstacle in a case where a mechanical type coin discrimination device which requires no connector means is mounted in said coin changer main part in lieu of said electronic type coin discrimination device.

4. A coin changer for a vending machine as defined in claim 1 wherein said discrimination means comprises a detection coil and a discrimination circuit which judges, in response to an output of said detection coil, whether the deposited coin is a true coin or a counterfeit one said electric wirings consist of wires which perform only functions of a power supply line for connecting said discrimination circuit to a power source and a control line for supplying the discrimination signal from said discrimination means to said electromagnetic device, and said connector means include pins corresponding to said electric wirings, each of said pins being capable of having such size and rigidness as to sufficiently withstand frequent detaching and attaching of said connector means.

* * * * *